US008154399B2

(12) United States Patent
Pellegrino et al.

(10) Patent No.: US 8,154,399 B2
(45) Date of Patent: Apr. 10, 2012

(54) METHOD OF OPERATING A NETWORKED CBRNE DETECTION SYSTEM

(75) Inventors: Francesco Pellegrino, Cold Spring Harbor, NY (US); Thomas J. Psinakis, East Meadow, NY (US); Raymond Morrissey, Elmont, NY (US); Robert D'Italia, Melville, NY (US); Edward J. Vinciguerra, North Bellmore, NY (US); Kevin J. Tupper, Huntington, NY (US); Marie Catherine Bruzzi, East Meadow, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 304 days.

(21) Appl. No.: 12/401,485

(22) Filed: Mar. 10, 2009

(65) Prior Publication Data

US 2009/0273471 A1 Nov. 5, 2009

Related U.S. Application Data

(60) Provisional application No. 61/035,296, filed on Mar. 10, 2008.

(51) Int. Cl.
*G08B 23/00* (2006.01)

(52) U.S. Cl. ..... 340/517; 340/521; 340/506; 340/540; 702/19; 702/22

(58) Field of Classification Search ..... 340/540, 340/506, 509, 511, 517, 521; 702/188, 189, 702/19, 22–32; 455/404.1, 404.2
See application file for complete search history.

(56) References Cited

U.S. PATENT DOCUMENTS

2006/0187017 A1* 8/2006 Kulesz et al. ..... 340/506
2007/0222585 A1* 9/2007 Sabol et al. ..... 340/539.11
2009/0055102 A1* 2/2009 Laufer et al. ..... 702/24

* cited by examiner

*Primary Examiner* — Benjamin C Lee
*Assistant Examiner* — Hongmin Fan
(74) *Attorney, Agent, or Firm* — DeMont & Breyer, LLC

(57) ABSTRACT

A CBRNE detection system and method for operating same are disclosed. The method provides a relatively increased Probability of Detection and a relatively decreased Probability of False Alarms for a networked system of detectors. In the illustrative embodiment, a central controller of the system is capable of receiving information from individual CBRNE detectors and of determining whether or not to issue an alarm indicating that a CBRNE event has occurred. Data obtained from individual CBRNE detectors is evaluated based on one or more "sensor alert-to-system alarm" processing modes. The various processing modes specify the requirements that must be satisfied before a system-wide "alarm" is issued.

19 Claims, 3 Drawing Sheets

METHOD OF OPERATING A NETWORKED CBRNE DETECTION SYSTEM

STATEMENT OF RELATED CASES

This case claims priority of U.S. Provisional Patent Application Ser. No. 61/035,296, filed Mar. 10, 2008 and incorporated by reference herein.

FIELD OF THE INVENTION

The present invention relates to Homeland Defense in general, and, more particularly, to CBRNE detection systems.

BACKGROUND OF THE INVENTION

A chemical, biological, radiological, nuclear or explosives ("CBRNE") attack can have a devastating effect on a civilian population. The best response requires the earliest possible detection of the attack so that individuals can flee and civil defense authorities can contain its effects. To this end, CBRNE detection systems are being developed for deployment in urban centers.

Accurately detecting the presence of CBRNE agents that have been released in a public environment is a challenging task. A variety of factors can hamper detection and lead to false alarms. These factors include: background fluctuations in a property being monitored (e.g., particulate size, etc.), the presences of interferants, differing temperature and humidity conditions, low signal-to-noise ratio of a detector, and detector malfunctions, among others.

The public will have little tolerance for false alarms, especially those that result in significant inconvenience, such as the disruption of mass transit facilities during rush hour. If the false alarms were to occur with regularity, a "boy-who-called-wolf" attitude could rapidly develop; that is, the public would soon learn to ignore the alarms.

One way to reduce the incidence of false alarms would be to decrease detector sensitivity. But this is not a workable solution because however inconvenient a false alarm might be, an undetected attack, as might result from intentionally decreasing detector sensitivity, is far worse.

The challenge, therefore, is to develop CBRNE detection systems that, relative to the prior art, provide an increased Probability of Detection ("PoD") and a decreased Probability of False Alarms ("PFA").

SUMMARY OF THE INVENTION

The present invention provides a CBRNE detection system and method that provides a relatively increased Probability of Detection and a relatively decreased Probability of False Alarms for a networked system of detectors.

A CBRNE detection system and method in accordance with the illustrative embodiment comprises a plurality of networked "remote" CBRNE detectors and a central control system. In the illustrative embodiment, the central control system is capable of receiving information from the CBRNE detectors and determining whether or not to issue an alarm indicating that a CBRNE event has occurred.

In accordance with the illustrative embodiment, data obtained from CBRNE detectors is evaluated based on one or more "sensor alert-to-system alarm" processing modes. The various processing modes specify the requirements that must be satisfied before a system-wide "alarm" is issued.

Implicit in the processing modes and evaluation of the data is the distinction between an "alert" and an "alarm." An "alert" is an indication (e.g., from a sensor, etc.) that a monitored parameter (e.g., concentration of particles in a certain size range, etc.) has breached a threshold established for that parameter. Such a breach indicates that the monitored parameter in the vicinity of the sensor location is present at a level, amount, etc., greater than would normally be expected. This breach or "alert" might be an indication of a CBRNE event.

An "alarm" issues when the system decides that a CBRNE event has occurred. Before the alert(s) causes an "alarm" to issue, there must be a sufficient level of confidence that the alert is valid. The various processing modes have different ways of determining whether this confidence level has been met.

In one mode, the "single detector" processing mode, the absolute level of a monitored agent, etc., as determined at a single CBRNE detector in the system, might be sufficient to cause the system to issue an alarm. In another mode, the "multi-detector corrobation" processing mode, a necessary (but not necessarily sufficient) condition for an alarm is that alerts must be indicated from at least two spatially disparate CBRNE detectors. In yet a third processing mode, the "orthogonal detector" processing mode, two different types of sensors that are capable of sensing the presence of the same CBRNE agent by using different technologies or detection modalities must corroborate each other's alert before an alarm will issue. Such sensors measure or otherwise evaluate independent agent parameters to reach a conclusion about the same CBRNE agent. Such sensors use different means or technologies to perform the measurements/evaluation.

The threshold levels at which alerts occur, and the selection of processing mode, can be dynamically altered during operation of the CBRNE system. The alteration can be based on environmental conditions, the data being generated by the sensors, or other parameters.

DETAILED DESCRIPTION

Definition of Terms

Figure 1:
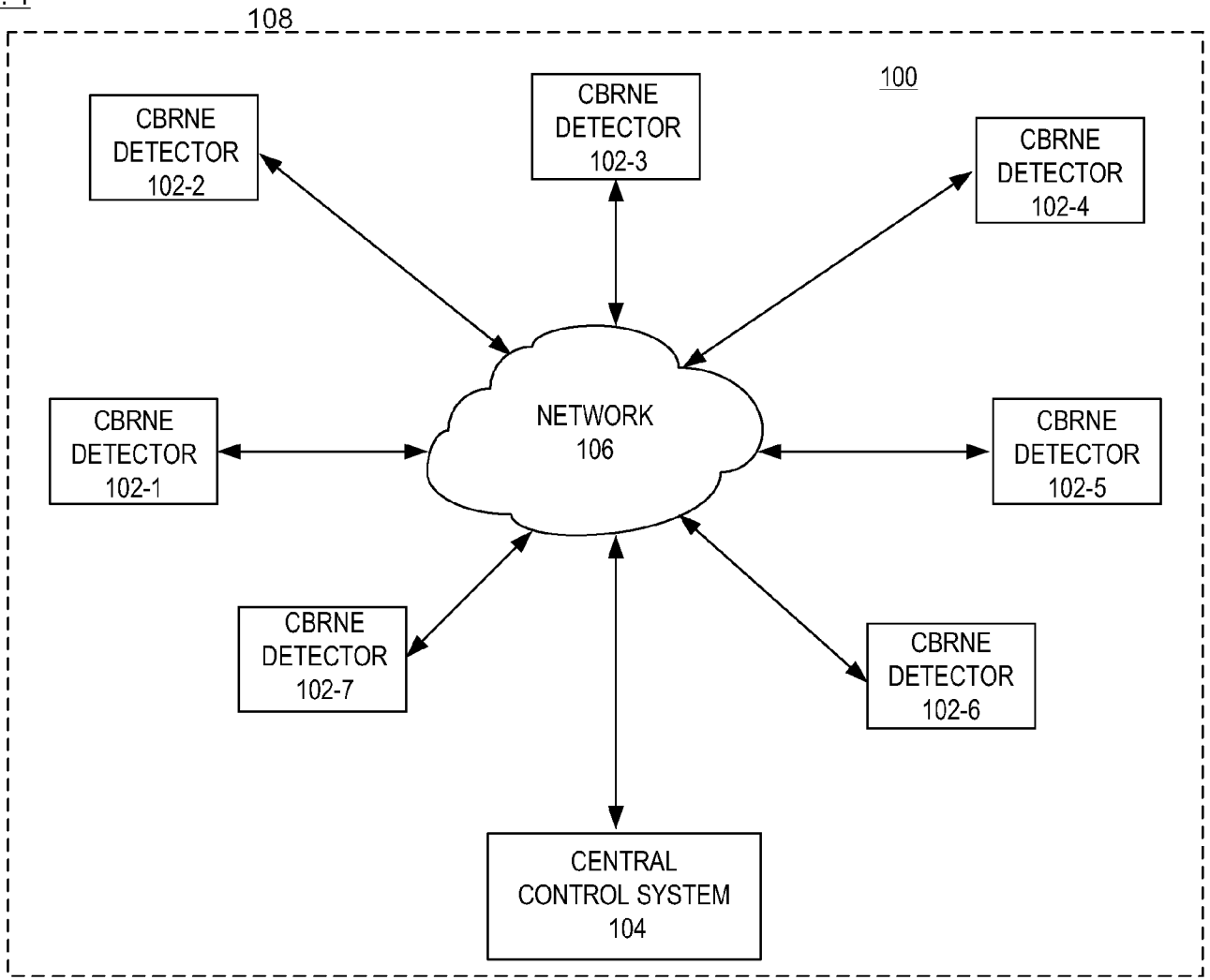
FIG. 1 depicts a block diagram of a CBRNE detection system in accordance with the illustrative embodiment of the present invention.

CBRNE. This acronym stands for weaponized or non-weaponized chemical warfare agents (including Toxic Industrial Chemicals), biological warfare agents, radiological isotopes, nuclear weapons and explosives. Weaponized materials can be delivered using conventional bombs (e.g., pipe bombs, etc.), improvised explosive materials (e.g., fuel oil-fertilizer mixture, etc.) and enhanced blast weapons. Non-weaponized materials are traditionally referred to as Dangerous Goods (DG) or Hazardous Materials (HAZMAT) and can include contaminated food, livestock and crops. As used herein, "CBRNE" is synonymous with "WMD."

Chemical warfare agent. A chemical warfare agent or chemical weapon includes those that are effective because of their toxicity; that is, their chemical action can cause death, permanent harm or temporarily incapacitate.

A common way to classify chemical agents is according to their degree of "effect" (i.e., harassing, incapacitating or lethal). This approach to classifying chemical agents is not particularly precise because the effects of chemical agents will depend on the dose received, and on the health and other factors that affect how susceptible people are to the agent.

Another form of classifying chemical agents is based on their effects on the body. Classifications include: nerve agents, respiratory agents, and blister agents. Nerve agents (e.g., Sarin, Soman, Tabun, VX, etc.) gain access to the body usually through the skin or lungs, and cause systemic effects. Respiratory agents (chlorine, phosgene, etc.) are inhaled and either cause damage to the lungs, or are absorbed there and cause systemic effects. Blister agents are absorbed through the skin, either damaging it (e.g., mustard gas, lewisite, etc.) or gaining access to the body to cause systemic effects or both.

A further classification is based on the duration of the hazard: persistent and non-persistent. Persistent agents remain in the area where they are applied for long periods (sometimes up to a few weeks). They are generally substances of low volatility that contaminate surfaces and have the potential to damage the skin if they come into contact with it. A secondary danger is inhalation of any vapors that may be released. Mustard gas and VX are examples of persistent agents. Non-persistent agents are volatile substances that evaporate or disperse quickly, and may be used to cause casualties in an area that the group using the weapons wants to occupy soon thereafter. Surfaces are generally not contaminated. The primary danger is from inhalation, and secondary danger is from skin exposure. Hydrogen cyanide and phosgene are typical non-persistent agents.

Biological warfare agent. Biological warfare agents or biological weapons are weapons that achieve their intended effects by infecting people with disease-causing microorganisms and other replicative entities, including viruses, infectious nucleic acids and prions.

The chief characteristic of biological agents is their ability to multiply in a host over time. The disease they may cause is the result of the interaction between the biological agent, the host (including the host's genetic constitution, nutritional status and the immunological status of the host's population) and the environment (e.g., sanitation, temperature, water quality, population density, etc.). Biological agents are commonly classified according to their taxonomy (i.e., fungi, bacteria, viruses). This classification is important because of its implications for detection, identification, prophylaxis and treatment. Biological agents can also be characterized by other features, such as infectivity, virulence, lethality, pathogenicity, incubation period, contagiousness, mechanisms of transmission, and stability, all of which affect their potential to be used as weapons.

Typical biological warfare agents of concern are Bacillus anthracis, Brucellus, Bubonic Plague, Tularemia, viruses, such as Venezuelan Equine Encephalitis (VEE).

Radiological material. A radiological weapon is any weapon that is designed to spread radioactive material with the intent to cause harm, kill, or effect a denial of the use of important facilities causing disruption upon a city or nation. This type of weapon is often referred to as a "dirty bomb" because it contaminates the environment with hard to remove radioactive material following an explosion. A dirty bomb typically uses conventional explosives to spread radioactive material, which are most commonly the spent fuels from nuclear power plants, industrial equipment, or radioactive medical waste.

Radiological weapons can render a great deal of property useless for an extended period, unless costly remediation is undertaken. The radiological source and its quality greatly impacts the effectiveness of a radiological weapon. Factors such as: energy and type of radiation, half-life, size of explosion, availability, shielding, portability, and the role of the environment (e.g., wind direction and strength, etc.) will determine the effect of the radiological weapon. Radioisotopes that pose the greatest security risk include: 137Cs, used in radiological medical equipment, 60Co, 241Am, 252Cf, 192Ir, 238Pu, 235U, 90Sr, and 226Ra. All of these isotopes, except for 226Ra, are normally created in nuclear power plants. While the amount of radiation dispersed from the event will likely be minimal, the fact that any radiation is dispersed may be enough to cause panic and disruption.

Nuclear weapons. There are two basic types of nuclear weapons. One produces its explosive energy through nuclear fission reactions alone. These are known colloquially as "atomic bombs." The second basic type of nuclear weapon produces a large amount of its energy through nuclear fusion reactions, and can be over a thousand times more powerful than fission bombs. These are known colloquially as "hydrogen bombs" or "thermonuclear bombs."

There are other types of nuclear weapons as well. For example, a boosted fission weapon is a fission bomb which increases its explosive yield through a small amount of fusion reactions, but it is not a hydrogen bomb. Some weapons are designed for special purposes; a neutron bomb is a nuclear weapon that yields a relatively small explosion but a relatively large amount of radiation; such a device could theoretically be used to cause massive casualties while leaving infrastructure mostly intact and creating a minimal amount of fallout. A salted bomb results when a nuclear weapon is surrounded by suitable materials, such as cobalt or gold. This device can produce exceptionally large quantities of radioactive contamination.

Explosives. For use herein, the term "explosives" includes conventional (not nuclear) and high-yield conventional explosives. Typical examples include TNT, PETN, C4, as well as fertilizers and certain peroxides.

CBRNE Agent. For use herein, the term "CBRNE agent" means a chemical warfare agent, or a biological warfare agent, or a radioisotope, or isotopes indicative of radiological nuclear materials, or species (e.g., chemicals, etc.) that are indicative of the presence of explosives.

CBRNE Event. For use herein, the phrase "CBRNE event" means an intentional (i.e., attack) or unintentional (i.e., accidental) release of one or more CBRNE agents.

CBRNE Detector. There is no single device or method that is capable of "detecting" the presence of chemical warfare agents, biological warfare agents, radiological/nuclear materials, and explosives. As a consequence, a "CBRNE detector" is, more accurately, a suite of sensors. Each sensor in the suite might be suitable for sensing/detecting one or more but typically not all of the five CBRNE categories. As used herein, the term "CBRNE detector" is understood to comprise one or more bundled sensors as a function of how many and which of the five primary weapon categories are being screened for.

It will be understood by those skilled in the art that the various individual sensors that are used for the sensing/detection of CBRNE agents do not necessarily sense or detect a CBRNE agent per se. Rather, in some cases, the sensors monitor parameters that, above certain thresholds, might be indicative of the presence of the CBRNE agent. For example, most weaponized biological warfare agents that are intended for inhalation will have a particle size in the range of about 1 to 10 microns. As a consequence, if an abnormally-high concentration of particles in that size range is detected, it might be indicative of the release of a biological warfare agent. Or, it could simply mean that that dust was stirred up by the passage of a car or train, etc. As a consequence, reference in this disclosure or the appended claims to sensing or detection of CBRNE agents is understood to include either the sensing or detection of the actual CBRNE agents via appropriate methods, or, alternatively, sensing or detection of agents, parameters, conditions, etc., that are indicative of the presence of CBRNE agents.

Detectors types. The choice of detector will be a function of the required sensitivity, the ability to detect a suitably wide range of agents within the particular class being monitored (e.g., the number of different chemical warfare agents that can be detected, etc.), the speed of detection, and the suitability of the detector for the form of the sample (e.g., solid, liquid, gas). In conjunction with the present disclosure, those skilled in the art will be able to select detectors suitable for detecting one or more of chemical warfare agents, biological warfare agents, radiological and nuclear materials, and/or explosives.

For chemical warfare agents, detection options include surface acoustic wave sensors, ion-mobility spectrometers, mass spectrometers, electrochemical sensors (e.g., chemi-resistive vapor techniques, etc), flame photometers, photo-ionization detectors and spectrophotometric sensors. Due to the complex nature of the chemical warfare agents and their matrices, non-separation-based analytical methods often experience interferences, which result in false positive or negative responses. Thus, some type of separation method is often coupled to an analytical detector to provide more specificity of response and a broader range of application. The most common separation devices are gas chromatography, liquid chromatography, capillary electrophoresis, ion mobility spectrometry, and mass spectrometry.

For biological warfare agents, detection options include aerosol particle sizers, flow cytometry, ultra-violet laser-induced fluorescence detectors, and mass spectrometers, among others. For identification, as opposed to simply detection, there are immunoassay-based detectors, genetic-based detectors, and mass spectroscopy (with separation via gas chromatography or liquid chromatography).

For radiological and nuclear materials, detection of alpha, beta, and gamma particles is achieved using Geiger Mueller tubes, sodium iodide (NaI), germanium (Ge), and cadmium zinc telluride (CZT) detectors, among others.

For explosives, an ion mobility spectrometer and/or mass spectrometer is typically used.

Threshold or threshold level(s). With regard to the measurement of a monitored parameter (e.g., airborne particulates in a certain size range, etc.), a threshold is used as a demarcation that segregates "expected" from "unexpected" values of the monitored parameter. When a threshold is breached, there is a possibility that unexpected increase above the threshold value of the monitored parameter is due to a CBRNE event (e.g., release of a biological warfare agent, etc.). As described herein, that possibility is evaluated in the context of the operating mode of the system and other factors. The threshold for any given monitored parameter can be dynamically varied as a function of any of a number of different parameters, including environmental, seasonal, time of day, and the like. Breaching a threshold gives rise to an "alert" (see definition below).

Alert vs. Alarm. An "alert" is a determination that signifies that a monitored parameter has exceeded a threshold (previously described) at a particular individual detector. Depending upon the particular operational mode (i.e., the "alert-to-alarm" mode, see description of method 400, below) of CBRNE detection system 100 at the time of the alert, the alert might need to be corroborated in some manner before a system "alarm" issues.

In some embodiments, operational/control personnel are not specifically apprised of the "alert" (until and unless the alert triggers an "alarm," as described below). For example, in some embodiments, the system doesn't specifically designate a breached threshold as an "alert;" rather, the system simply follows the alarm logic to decide whether or not a system-wide alarm should issue based on a breached threshold. In some other embodiments, an actual "alert" is issued by the system to notify control personnel that a threshold has been exceeded.

As used in this specification, the term "alarm" indicates that, based on the available alert data that is received from one or more individual CBRNE detectors, CBRNE detection system 100 has determined that a CBRNE system-level event (e.g., attack, accident, etc.) has occurred. The alarm issues as an auditory indication (e.g., siren, public announcement, etc.) and is typically accompanied by a visual indication on a control panel or display screen and/or notification to appropriate responsible agencies and First Responders.

Turning now to a description of the Figures, FIG. 1 depicts CBRNE detection system 100 in accordance with the illustrative embodiment of the present invention. System 100 comprises a plurality of networked CBRNE detectors 102-1 through 102-7, which are collectively referenced "detectors 102" or individually but generically referenced **102-*i* and central control system 104**.

Figure 2:
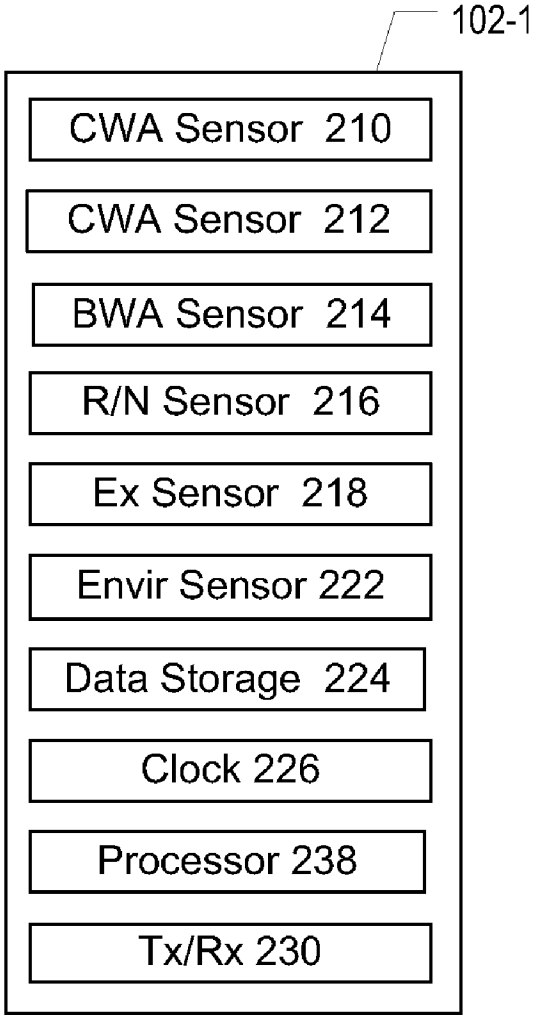
FIG. 2 depicts a block diagram of a remote CBRNE detector for use in the system of FIG. 1.

As described further in conjunction with FIG. 2, each detector **102-*i* is capable of monitoring for the presence of one or more CBRNE agents, in addition to other functionality. Detectors 102 are sited at installation 108 (see, e.g., FIG. 1), which is a location that is to be monitored for a CBRNE event. Installation 108** can be a public facility, such as a train station, subway station, bus depot, store, stadium, etc., or a private facility. Furthermore, it can be an outdoor facility or an indoor facility.

In the illustrative embodiment, CBRNE detectors 102 are networked to central control system 104 via network 106. The specifics of network 106 are typically a function of the size of the installation being protected. Network 106 can be a private network, a virtual private network, a wide area network (WAN), a metropolitan area network (MAN), internets, or the Internet, or combinations thereof. Communications to and from network 106 can be wireless, wire line, or a combination thereof. In some embodiments, CBRNE detectors 102 are networked to each other instead of or in addition to being networked to central control system 104.

In the illustrative embodiment, central control system 104 is capable of receiving information from CBRNE detectors 102 and determining, based on "alarm logic," whether or not to issue an alarm indicating that a CBRNE event has occurred. Central control system 104 is described in further detail in conjunction with a discussion of FIGS. 3 and 4.

FIG. 2 depicts a block diagram of a CBRNE detector 102-*i*, which is suitable for use in conjunction with system 100. As per the definitions previously provided, each CBRNE detector 102-*i* comprises at least one (and typically more than one) sensor for providing a desired scope of CBRNE screening (e.g., chemical and explosives only, or chemical, biological, and explosives, or chemical, explosives, radiological, and nuclear, etc.). In FIG. 2, CBRNE detector 102-*i* includes five individual CBRNE-agent sensors: 210, 212, 214, 216, and 218.

In some embodiments, each individual sensor in the CBRNE detector is intended to monitor the protected installation for the same or a different one of the five CBRNE agents. In some other embodiments, a given detector 102-*i* performs "double-duty," monitoring for more than one type of agent, as appropriate. For example, chemical warfare agents and explosives can be monitored by the same type of sensor, radiological agents and nuclear material can be monitored by the same type of sensor, etc.

In some embodiments, the suite of sensors within a CBRNE detector 102-*i* will include two or more sensors that are capable of monitoring for the same CBRNE agent, albeit via a different analytical approach. For example, a surface acoustic wave sensor and an ion-mobility spectrometer sensor can both be used to detect a chemical warfare agent. As used herein, the term "orthogonal" is used to describe two or more sensors that sense the same CBRNE agent albeit via different methodologies.

In some embodiments, CBRNE detector 102-*i* that is depicted in FIG. 2, includes:

- sensor 210 for sensing/detecting the presence of chemical warfare agents by a first methodology;
- sensor 212 for sensing/detecting the presence of chemical warfare agents by a second methodology that is different from the first methodology used by sensor 210;
- sensor 214 for sensing/detecting the presence of biological warfare agents;
- sensor 216 for sensing/detecting the presence of radiological or nuclear material; and
- sensor 218 for sensing/detecting the presence of explosives.

In the illustrative embodiment, CBRNE detector 102-*i* includes environmental sensor suite 222. The environmental sensor is typically a suite of sensors that are capable of sensing various environmental conditions. For example, in various embodiments, sensor suite 222 includes one or more of the following sensors: a wind-speed sensor, a wind-direction sensor, a barometric-pressure sensor, a temperature sensor, a sunlight sensor, a humidity sensor, a precipitation sensor, and an acoustic sensor.

The selection of sensors is a function of the nature of installation 108 that is being monitored, among any other factors. That is, to the extent installation 108 is a covered installation, indoors, or underground, the rain sensor and sunlight sensor are typically not included. Wind speed might or might not be included depending upon the nature of the "indoor" facility. For example, if installed in a subway, a wind-speed sensor would typically be included in the sensor suite 222 since air currents on the platform will fluctuate with the passage of a train.

As described later in this specification in conjunction with a discussion of method 400, environmental sensor suite 222 provides the alarm logic with an ability to dynamically adjust "alert" thresholds. In fact, there are several ways to use the information from environmental sensor suite 222 to dynamically adjust such thresholds, including:

- Evaluating the potential efficacy of a CBRNE event (which relates to its likelihood of occurrence) as a function of environmental conditions (e.g., reduce thresholds if an attack is expected to be relatively more likely as a function of the environmental condition, relax conditions pertaining to corroboration of an alert, etc.);
- Using environmental conditions in modeling algorithms to predict time of arrival and concentration of a cloud of a CBRNE agent (e.g., adjusting the threshold levels at a "downstream" detector based on expected CBRNE-agent concentration, etc.);
- Correlating environmental conditions to expected changes in a monitored parameter (e.g., increasing the threshold level for airborne particulates during a certain time interval because the increase in air currents due to passage of a train increases the airborne particle count during that time interval, etc.)

The ability to dynamically adjust alert thresholds in this fashion improves the Probability of Detection (PoD) and/or decreases the Probability of False Alarms (PoF). The topic of dynamically adjusting alert thresholds is described in further detail below in conjunction with method 400.

Data storage device 224 is used to store the output from the various sensors of CBRNE detector 102-*i* for eventual transmission to central control station 104.

In the illustrative embodiment, data from CBRNE detectors 102 is migrated "up" to central control system 104 for processing. But in some embodiments, the CBRNE detectors function more autonomously and, in fact, are capable of processing the data from the resident sensors as well as data from other of the CBRNE detectors 102 in system 100. For such embodiments, the CBRNE detectors include a real-time clock 226 and processor 228, in addition to data storage device 224. The clock is used, for example, to predict the arrival time of a CBRNE agent at a given CBRNE detector, as described above. The data storage device stores processing algorithms (e.g., computational fluid dynamics, etc.) run by processor 228, data from the various sensors, and information concerning the layout (e.g., location of CBRNE detectors, etc.) of system 100.

It is notable that in embodiments in which environmental sensor suite 222 includes an acoustic sensor, the acoustic sensor can be used in conjunction with one of the CBRNE sensors to provide an "orthogonal" sensing pair. Specifically, the acoustic sensor can obtain an acoustic fingerprint of the monitored region. If the fingerprint is indicative of sounds that might accompany the release of a CBRNE agent (e.g., breaking of a bottle, the sound of gas escaping from a pressurized container, an explosion, sounds attributable to general commotion), it provides a level of validation for an attack indication from the paired sensor. In this fashion, the use of orthogonal sensors improves the Probability of Detection and decreases the Probability of False Alarms.

In the illustrative embodiment, transceiver 230 transmits various sensor output from CBRNE detector 102-*i* to central control system 104 via network 106. As a function of the extent to which processing occurs at the CBRNE detector level, transceiver 230 might also receive data from other CBRNE detectors 102 or central control station 104.

Figure 3:
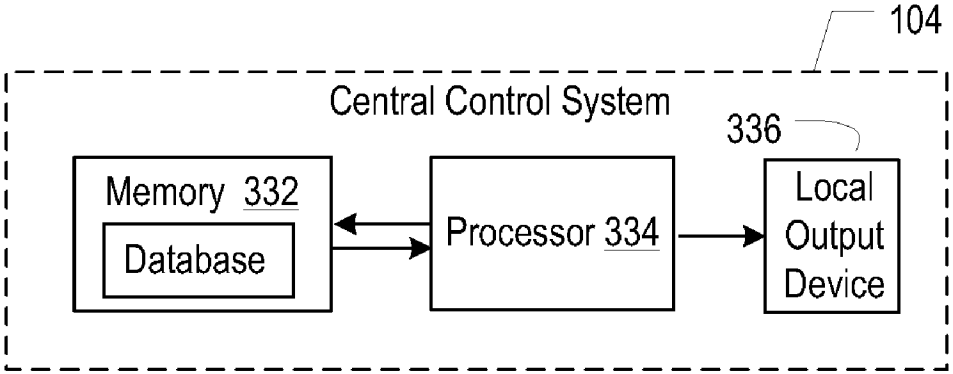
FIG. 3 depicts a block diagram of a central control system for use in the system of FIG. 1

FIG. 3 depicts a block diagram of central control system 104. In the illustrative embodiment, central control system 104 comprises data storage device 332, processor 334, and local output device 336.

Data storage device 332 is advantageously a non-volatile memory, such as a hard disk. Data storage device 332 stores information that is received from the various CBRNE detectors 102, information about system 100, various algorithms, in the form of program code, for execution by processor 334, intermediate processing results, etc.

Processor 334 is advantageously a general-purpose processor, as is well-known in the art, that is capable of:

- receiving data from (and, in some embodiments, outputting data to) network 106;
- executing one or more programs that are stored in data storage device 332 for adjusting alarm thresholds, defining alert-to-alarm modes, and other decision making algorithms, etc.;
- storing data in and retrieving data from data storage device 332;
- providing data to output device 336.

Output device 336 is video display and/or speaker, such as can be used for issuing an alarm to indicate that a CBRNE event has occurred.

Figure 4:
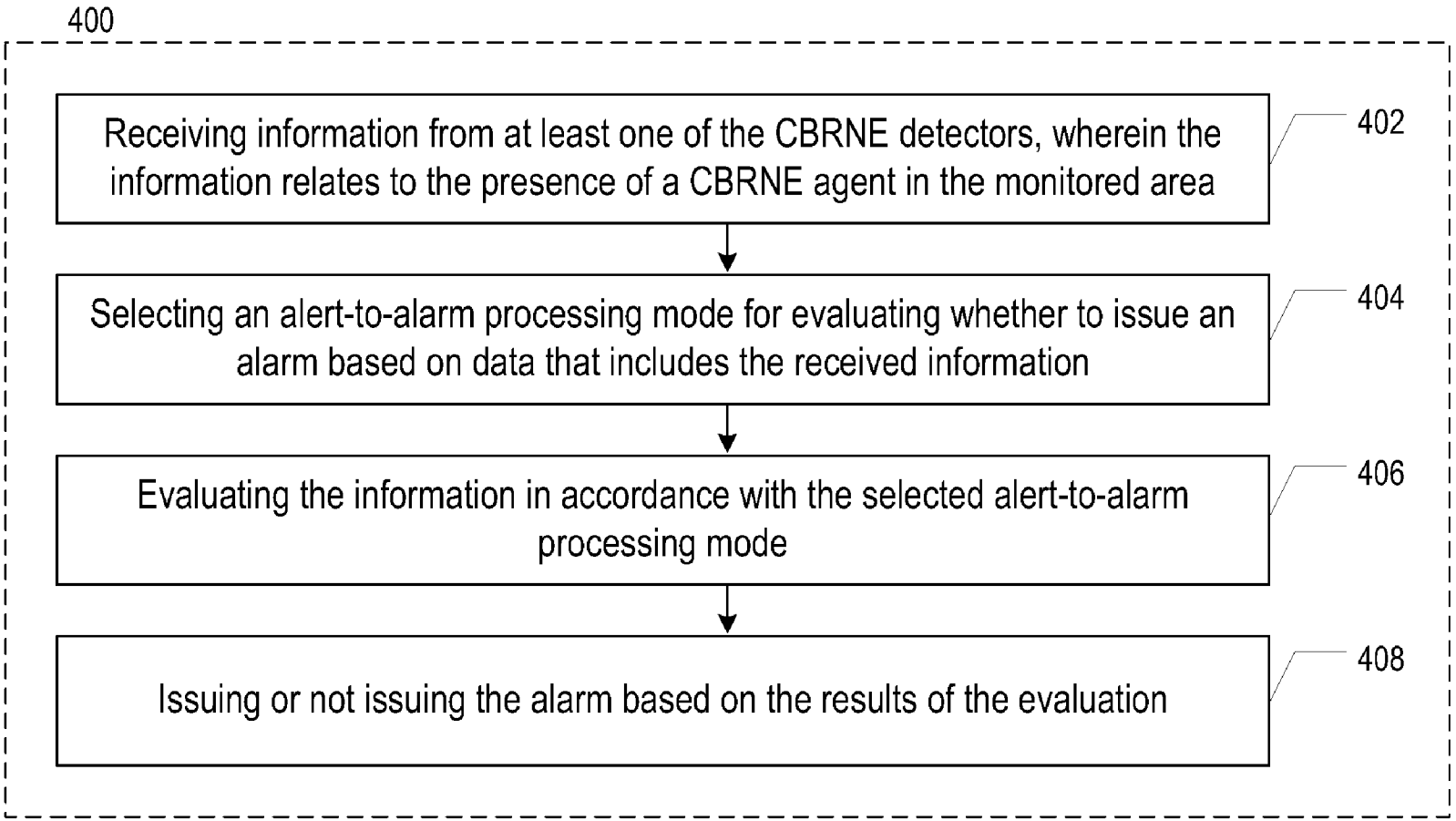
FIG. 4 depicts a flow diagram of a method for operating the system of FIG. 1.

FIG. 4 depicts method 400 for operating system 100 in accordance with the illustrative embodiment of the present invention. Method 400 includes the tasks of:

- 402: Receiving information from at least one of the CBRNE detectors;
- 404: Selecting an "alert-to-arm" processing mode;
- 406: Evaluating the information in accordance with the selected mode; and
- 408: Issuing or not issuing an alarm based on the results of the evaluation.

Regarding task 402, in some embodiments in which decision making occurs at the level of central control system 104, the "information" is received by central control system 104 via network 106. In some embodiments, the "information" comprises the output from one or more of the various sensors (e.g., sensors 210 through 218, etc.) of all CBRNE detectors in system 100.

In the illustrative embodiment, the information is typically received on a substantially continuous basis whereby CBRNE detectors 102 transmit data, sequentially, to central control system 104. Thus, a data transmission cycle is created. After all CBRNE detectors in system 100 have uploaded their data to the central control system, a cycle is complete and a subsequent data transmission cycle begins. Other bases for transmitting the data can suitably be used.

Furthermore, to the extent that a detection threshold is exceeded, the routine data transmission cycle can be preempted in accordance with alarm logic. Transmission then proceeds out of the defined order and timing based on the expected propagation of the detected CBRNE agent to certain CBRNE detectors (i.e., based on prevailing air currents and separation distance from the point of initial detection).

In some embodiments in which decision making occurs at the level of CBRNE detectors 102, the "information" is received by one or more CBRNE detectors 102-*i* in system 100 via network 106. In some embodiments, the "information" comprises the output from one or more of the various CBRNE-agent sensors (e.g., sensors 210 through 218, etc.) of other CBRNE detectors in system 100.

For example, in some embodiments, when an alert is triggered at one of CBRNE detectors 102-*i* (i.e., a threshold of one of the sensors in that detector is exceeded), that detector transmits information to all other detectors in system 100. In some embodiments, the transmitted information includes data pertaining to the sensor that registered the alert as well as data from environmental sensor suite 222. In some other embodiments, the output from all sensors is transmitted to the other detectors.

In some other embodiments, decision making is distributed, wherein some processing is performed at CBRNE detectors 102 and some is performed by central control system 104. For example, alerts are determined at the level of CBRNE detectors 102 while the decision to issue an alarm is evaluated by central control system 104. In some embodiments, individual CBRNE detectors report on a cyclical and non-continuous basis (e.g., individual detectors report once per two minutes, etc.). If an individual CBRNE detector 102-*i* determines that a sensor threshold is exceeded, that CBRNE detector reports (out of order) to central control system 104. After the central control system receives the alert, the data transmission schedule is altered. For example, in some embodiments, the CBRNE detectors in the system begin transmitting output from their sensors on a more frequent basis (e.g., individual detectors report once every 15 seconds, etc.) Alternatively, once it receives an alert, central control system 104 can establish a polling routine for requesting data from some or all of CBRNE detectors 102 as appropriate.

Task 404 recites "selecting an 'alert-to-alarm' processing mode." Each alert-to-alarm processing mode includes an alarm logic that specifies the conditions that must exist before an alarm issues based upon alert(s) that are registered by one or more CBRNE detectors in the system.

In accordance with the illustrative embodiment, there are three alert-to-alarm processing modes that can be selected. The alert-to-alarm processing modes include:

- a "single detector" mode, wherein an indication of a breached threshold from a single sensor within a CBRNE detector is capable of triggering an alarm;
- a "multi-detector corrobation" mode, wherein an indication of a breached threshold from two or more of the CBRNE detectors is required to trigger an alarm; and
- an "orthogonal-detector corrobation" mode, wherein a breached threshold from at least two sensors that use different detection technologies for detecting the same monitored agent/parameter or otherwise corroborate the same type of event is required to trigger the alarm.

Single Detector Mode. Compare two scenarios: an alert from a single sensor and alerts from multiple sensors. It is clear that a single alert issuing from a single sensor has a greater probability of being false than a plurality of alerts issuing from multiple sensors, since in the latter scenario, there is a measure of corroboration. Notwithstanding such corroboration, if a single sensor reports the value of a monitored parameter as being sufficiently high (substantially exceeding a threshold), then the confidence in that single alert rises and, in some circumstances, will be a sufficient condition for issuing an alarm.

The concept of "sufficiently high" is best determined by experience. For example, it is preferable that at least one years' worth of data concerning variations in background levels of the monitored parameter be obtained. Tracking the parameter for a year would account for any seasonal variations. In some embodiments, the "sufficiently high" value would be a value that exceeds the average value observed for the background levels of the monitored parameter over the course of the year of data tracking. Thus, the "threshold" would be set above this average value by a set number of standard deviations obtained from the measured data.

In some embodiments, it requires more than one alert from the indicating sensor to trigger an alarm. For example, in some embodiments, when system 100 is in the single detector mode, the system requires additional alerts from the same sensor before triggering an alarm. In some embodiments, algorithms are used to predict the dispersion of the "detected" CBRNE agent over time at the sensor based on data from environmental sensor suite 222. The predictions are compared to actual readings. Agreement, or lack thereof, between the predicted value and actual readings can be used to determine if the initial alert was simply an aberrant reading or a bona fide CBRNE event.

Multiple Detector Corrobation Mode. As previously disclosed, corroborating alerts from different CBRNE detectors decrease the probability of false alarms. Furthermore, since thresholds can be set lower than for the single detector mode, the probability of detection is increased (relative to the single detector mode). There are several ways to "corroborate" alerts issued by different CBRNE detectors, as discussed further below in conjunction with task 406.

Orthogonal Detector corroboration mode. As previously disclosed, when system 100 is in this operating mode, it will not issue an alarm unless there are corroborating alerts from at least two different types of sensors. In some embodiments, the different types of sensors will use different operating principles for detecting the same monitored agent/parameter (e.g., an aerosol particle sizer and an ultra-violet laser-induced fluorescence sensor for a biological warfare agent, etc.)

In some other embodiments, the cross correlation could be between one CBRNE sensor and environmental sensor suite 222. For example, certain acoustic fingerprints might be indicative of sounds that accompany the release of a CBRNE agent (e.g., the breaking of a bottle, the sound of gas escaping from a pressurized container, an explosion, sounds attributable to general commotion). As a consequence, if an alert, as issued by one of the CBRNE sensors and an acoustic fingerprint that is possibly indicative of a CBRNE event, as obtained by an acoustic sensor, fall into an appropriate time window, it might provide the cross correlation required to issue an alarm. See, U.S. patent application Ser. No. 11/536,610, which is incorporated by reference herein.

Mode Selection. It is notable that in method 400, task 404 (select mode) follows task 402 (receive information). It is to be understood, however, that selection of the processing mode can occur before task 402 and, in fact, selection can occur before system 100 is even commissioned.

More particularly, an alert-to-alarm processing mode, or changes in the processing mode, can be pre-established based on training of the system, a neural network, fuzzy logic, or experience, etc. In some embodiments, a processing mode for the system is user selected and remains fixed during operation. In some other embodiments, the processing mode is user selected and changes in the processing mode are pre-selected. For example, the system could be started in the single detector mode and then be programmed to switch to the multi-detector corroboration mode as soon as an elevated but below threshold level of a monitored parameter is observed, etc.

In some other embodiments, the processing mode is user selected for start-up and then changes processing mode, as appropriate, based on a set of rules. For example, and without limitation, the change could be triggered by:

- the output from the CBRNE sensors;
- the output from the environmental sensor suite (conditions might indicate an improved efficacy for a CBRNE event, suggesting an increased probability of attack);
- calendrical time (time of day, season of the year, etc.);
- National Security alert levels as may be determined by National, State, or Local security or law enforcement agencies.

In some further embodiments, system 100 utilizes multiple processing modes simultaneously, wherein, if any of the processing modes would issue an alarm based on CBRNE detector output, an alarm issues. In some additional embodiments, system 100 runs multiple processing modes simultaneously and requires corroboration across processing modes to issue an alarm. In other words, the system might operate so that a (relatively higher) threshold established for the single detector mode must be breached and multiple detectors must corroborate alerts (in the multi-detector corroboration mode) for an alarm to issue.

Task 406 of method 400 recites "evaluating the information [received from the CBRNE detector(s)] in accordance with the selected [processing] mode."

To evaluate the information obtained by the various sensors of a CBRNE detector 102-*i*, threshold levels must be established for each of the parameters that are being monitored. This can be done in a variety of ways that are known to those skilled in the art. In some embodiments, a dynamic threshold is established in accordance with the methods described in co-pending U.S. patent application Ser. Nos. 11/212,342 and 11/212,343, which applications are incorporated by reference herein.

The "multi-detector" and "orthogonal detector" alert-to-alarm processing modes require corroboration of alerts before issuing an alarm. A variety of corroboration techniques are available. For example, for either of these corrobation-required processing modes, the following methods of corroboration, among others, are available:

- Corroborating in time, which decreases false alarms generated by transitory background signals;
- Corroborating in space, which decreases false alarms generated by localized background fluctuations;
- Windowing criteria, which decrease false alarms by ensuring that multiple alarms from different CBRNE detectors occur within plausible time windows based on airflow limitations in the monitored facility.

Corroboration in time. In some embodiments, before issuing an alarm that is based on alerts issued from two or more different CBRNE detectors, the alerts from the issuing detectors must be received across several temporal cycles. That is, to the extent that alerts are received at time $t_1$ by several CBRNE detectors, they also must be received at future times $t_2$ and $t_3$ by those detectors. The reason for this is, in the event of a CBRNE event, the monitored parameter is likely to maintain its threshold-breaching levels for a period of time (e.g., it takes some time for airborne chemical or biological agents to disperse, etc.). In the absence of a sustained indication or other corroboration, the alert can be considered to be false.

Corroboration in space. Each of the CBRNE detectors within system 100 will be located some known distance from one another. Based on separation distance between the CBRNE detectors and the direction and speed of prevailing air currents in the monitored installation (as obtained from environmental sensor suite 222), a time of propagation of a CBRNE agent from the CBRNE detector that issued the alert to other CBRNE detectors can be estimated. Furthermore, an expected concentration level at other CBRNE detectors can be estimated from computational fluid dynamics models or other means. As a consequence, to the extent the subject CBRNE agent is either not detected, or is detected but at other than expected values at other CBRNE detectors in the system, the alert is not corroborated.

Windowing criteria. Similar in concept to corroboration in space, once an alert is issued by a CBRNE detector, the time at which subsequent alerts should be issued by other detectors can be calculated. Based on this, a polling schedule can be developed. If the subject CBRNE agent is not present, or is present but at other than expected levels at other detectors when they are polled, the alert is not corroborated.

In some embodiments, data from environmental sensor suite 222 is suitably used for establishing thresholds and evaluating CBRNE sensor data and other tasks. For example, one use for the information arises based on the fact that the various environmental factors that are monitored can be correlated to the efficacy, and, therefore, the likelihood of a CBRNE attack. This information can then be used to place CBRNE detection system on a relatively higher state of alert, which can be implemented, for example, by lowering the thresholds that, when exceeded, are indicative of a CBRNE event. See U.S. patent application Ser. No. 11/743,946, which is incorporated by reference herein.

Furthermore, the information that is obtained from environmental sensor suite 222 can be used in support of the "corroboration in space" and "windowing" techniques. In particular, sensor data is used in conjunction with various modeling software (e.g., computational fluid dynamics, etc.) for characterizing the progress of a "cloud" of gas, etc., that is moving through a monitored installation. Thus, if data from a CBRNE sensor indicates that a CBRNE agent is present in excess of a threshold at CBRNE detector 102-6 (FIG. 1), the information obtained from environmental sensor suite 222 can be used to predict the time at which the elevated concentration or cloud of the CBRNE agent should reach other CBRNE detectors (e.g., 102-7, 102-5, etc.) and to predict the expected levels of the CBRNE agent as measured such other detectors.

In addition to providing information that (1) can be predictive of the likelihood of an attack occurring and (2) can be used in conjunction with modeling software for predicting "cloud" movement, etc., as described above, environmental sensor suite 222 also provides information that can be used to dynamically adjust "alert" thresholds. For example, in a subway station, an increase in airborne particle count is reasonably expected to be measured at a CBRNE detector as a train passes. This is due to an increase in air flow/air currents, which tend to pick-up dust, etc. In some embodiments, if the increase in particle count, as measured by at a CBRNE detector, is accompanied by an indication of increased air currents as measured by environmental sensor suite 222 on that detector, the "alert" threshold is adjusted upward. That is, if the nominal background particle count is expected to increase as a consequence of the increase in air currents, the threshold at which an "alert" is triggered should be raised to decrease the probability of a false alert.

Furthermore, acoustic sensor data from environmental sensor suite 222 can be used in conjunction with the orthogonal detector mode, wherein CBRNE sensor data and acoustic sensor data are compared for corroboration purposes. See, U.S. patent application Ser. No. 11/536,610.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A method for operating a CBRNE detection system that comprises a plurality of CBRNE detectors that monitor one or more parameters that, as a function of a value thereof, are potentially indicative of elevated levels of a CBRNE agent and of the occurrence of a CBRNE event, wherein the method comprises:

selecting a first alert-to-alarm processing mode from a plurality of different alert-to-alarm processing modes, wherein the alert-to-alarm processing modes determine whether or not to issue an alarm that a CBRNE event has occurred based on one or more alerts from one or more CBRNE detectors, wherein the alerts signify that the one or more parameters meet or exceed a threshold;

changing to a second alert-to-alarm processing mode based on a triggering condition selected from the group consisting of an output from an environmental sensor suite, calendrical time, a security alert level as determined by an agency;

evaluating the alerts in accordance with at least the second alert-to-alarm processing mode; and issuing or not issuing the alarm based on the results of the evaluation.

2. The method of claim 1 wherein the operation of evaluating the alerts further comprising evaluating the alerts in accordance with both the first alert-to-arm processing mode and the second alert-to-arm processing mode and further wherein the alarm is issued only when the evaluations of both the first alert-to-alarm processing mode and the second alert-to-alarm processing mode corroborate one another.

3. The method of claim 1 and further wherein:

at least one of the first alert-to-alarm processing mode or the second alert-to alarm processing mode requires corroboration of an alert between at least two detectors before an alarm is issued; and a corroboration method for corroborating the alert is selected from the group consisting of corroboration in time, corroboration in space, and windowing criteria.

4. The method of claim 1 further comprising dynamically adjusting the threshold for an alert based on environmental information.

5. The method of claim 1 wherein the operation of selecting a first alert-to-alarm processing mode further comprises periodically adjusting the threshold based on fluctuations in an expected background level of the monitored one or more parameters.

6. The method of claim 4 wherein the operation of dynamically adjusting the threshold further comprises dynamically adjusting the threshold based on an evaluation of a potential efficacy of a CBRNE event based on prevailing environmental conditions.

7. The method of claim 4 wherein the operation of dynamically adjusting the threshold further comprises dynamically adjusting the threshold based on an expected change in the monitored one or more parameters, wherein the change is expected based on a changed environmental condition.

8. The method of claim 1 wherein the operation of selecting an alert-to-alarm processing mode further comprises establishing an alarm logic, wherein establishing alarm logic comprises establishing rules for dynamically selecting the alert-to-alarm processing mode.

9. The method of claim 8 further comprising modifying the alarm logic by adjusting at least one logic parameter selected from the group consisting of: requirements for corroboration in time, requirements for corroboration in space, and windowing criteria.

10. The method of claim 8 wherein the operation of establishing the alarm logic further comprises establishing a time window for corroborating alerts between different CBRNE detectors, wherein the time window is a function of a distance between the different CBRNE detectors and an expected propagation rate of a CBRNE agent.

11. The method of claim 1 wherein the first alert-to-alarm processing mode is selected from the group consisting of:

(a) a single-detector mode wherein an alert from a single CBRNE detector is capable of triggering the alarm;

(b) a multi-detector corrobation mode wherein alerts from at least two of the CBRNE detectors are required to trigger the alarm; and (c) an orthogonal-detector corrobation mode wherein alerts from at least two CBRNE detectors that use different detection technologies to detect the same CBRNE agent are required to trigger the alarm.

12. The method of claim 11 wherein the second alert-to-alarm processing mode is selected from the same group of processing modes as the first alert-to-alarm processing mode, but the processing mode selected for the second alert-to-alarm processing mode must be different from the processing mode selected for the first alert-to-alarm processing mode.

13. The method of claim 12 further comprising the operation of establishing an alarm logic, wherein when the first alert-to-alarm processing mode is the single-detector mode and the second alert-to-alarm processing mode is the multi-detector corroboration mode or the orthogonal-detector corroboration mode, the operation of establishing alarm logic comprises decreasing a threshold.

14. A method for operating a CBRNE detection system that comprises a plurality of CBRNE detectors that monitor one or more parameters that, as a function of a value thereof, are potentially indicative of elevated levels of a CBRNE agent and of the occurrence of a CBRNE event, wherein the method comprises:

selecting a single-detector alert-to-alarm processing mode wherein an alert from a single CBRNE detector that a CBRNE event has occurred triggers an alarm, wherein the alert signifies that the one or more parameters meet or exceed a threshold;

changing to a multi-detector corroboration alert-to-alarm processing mode upon occurrence of a triggering condition selected from the group consisting of an output from an environmental sensor suite, calendrical time, a security alert level as determined by an agency, wherein the multi-detector corrobation mode requires alerts from at least two CBRNE detectors to trigger an alarm;

evaluating the alerts in accordance with at least the second alert-to-alarm processing mode; and issuing or not issuing the alarm based on the results of the evaluation.

15. The method of claim 14 wherein the threshold is periodically adjusted based on fluctuations in an expected background level of the monitored one or more parameters.

16. The method of claim 14 further comprising dynamically adjusting the threshold based on information from an environmental sensor, wherein threshold is adjusted based on an evaluation of a potential efficacy of a CBRNE event based on prevailing environmental conditions.

17. A method for operating a CBRNE detection system that comprises a plurality of CBRNE detectors that monitor one or more parameters that, as a function of a value thereof, are potentially indicative of elevated levels of a CBRNE agent and of the occurrence of a CBRNE event, wherein the method comprises:

selecting a single-detector alert-to-alarm processing mode wherein an alert from a single CBRNE detector that a CBRNE event has occurred triggers an alarm, wherein the alert signifies that the one or more parameters meet or exceed a threshold;

changing to an orthogonal-detector corroboration alert-to-alarm processing mode upon occurrence of a triggering condition selected from the group consisting of an output from an environmental sensor suite, calendrical time, a security alert level as determined by an agency, wherein the orthogonal-detector corrobation mode requires alerts from at least two CBRNE detectors that use different detection technologies to detect the same CBRNE agent to trigger an alarm;

evaluating the alerts in accordance with at least the second alert-to-alarm processing mode; and issuing or not issuing the alarm based on the results of the evaluation.

18. The method of claim 17 wherein the threshold is periodically adjusted based on fluctuations in an expected background level of the monitored one or more parameters.

19. The method of claim 17 further comprising dynamically adjusting the threshold based on information from an environmental sensor, wherein threshold is adjusted based on an evaluation of a potential efficacy of a CBRNE event based on prevailing environmental conditions.

* * * * *